US008186335B2

(12) United States Patent
Ishibashi et al.

(10) Patent No.: US 8,186,335 B2
(45) Date of Patent: May 29, 2012

(54) LOAD CONTROL MECHANISM FOR INTERNAL COMBUSTION ENGINE

(75) Inventors: Yoichi Ishibashi, Saitama (JP); Hideaki Morikawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 883 days.

(21) Appl. No.: 12/237,730

(22) Filed: Sep. 25, 2008

(65) Prior Publication Data

US 2009/0084365 A1 Apr. 2, 2009

(30) Foreign Application Priority Data

Sep. 28, 2007 (JP) ..... 2007-255474

(51) Int. Cl.
*F02B 47/08* (2006.01)
*F02M 25/07* (2006.01)
*F01L 1/34* (2006.01)

(52) U.S. Cl. ..... 123/568.13

(58) Field of Classification Search .... 123/90.15–90.17, 123/568.11, 568.13, 568.14, 568.21, 568.22, 123/568.31, 568.16, 568.26, 435, 676
See application file for complete search history.

(56) References Cited

U.S. PATENT DOCUMENTS 4,735,186 A * 4/1988 Parsons ..... 123/3
5,425,346 A * 6/1995 Mavinahally ..... 123/568.13
5,461,569 A * 10/1995 Hara et al. ..... 701/101
5,782,226 A 7/1998 Gartner
5,950,604 A * 9/1999 Inamijima ..... 123/568.11
6,230,694 B1 * 5/2001 Cook et al. ..... 123/568.11
6,672,061 B2 * 1/2004 Schmid et al. ..... 60/605.2
6,694,956 B2 * 2/2004 Kawaguchi et al. ..... 123/568.21
6,708,678 B2 * 3/2004 Hagari ..... 123/568.22
7,055,508 B2 * 6/2006 Matsunaga et al. ..... 123/568.21

FOREIGN PATENT DOCUMENTS

JP 2006-233963 A 9/2006

* cited by examiner

*Primary Examiner* — Willis Wolfe, Jr.
*Assistant Examiner* — Johnny Hoang
(74) *Attorney, Agent, or Firm* — Birch, Stewart, Kolasch & Birch, LLP

(57) ABSTRACT

To avoid the generation of a pumping loss, a communication passage is formed as a bypass passage between an exhaust port and a combustion chamber in an internal combustion engine. The communication passage is provided with a one-way valve as an exhaust gas return amount adjustment means. The one-way valve includes a spring member having a spring constant set to the value such that a valve body does not displace toward the combustion chamber under the pressure of the exhaust gas in the exhaust port. An opening degree of the one-way valve is autonomously adjusted depending on the amount of air introduced from an intake manifold when the pressure within the combustion chamber becomes negative in the intake stroke. Then inside of the combustion chamber is kept at substantially the atmospheric pressure with the exhaust gas returned to the combustion chamber via the communication passage and the aforementioned air.

20 Claims, 6 Drawing Sheets

LOAD CONTROL MECHANISM FOR INTERNAL COMBUSTION ENGINE

CROSS-REFERENCE TO RELATED APPLICATIONS

The present application claims priority under 35 USC 119 to Japanese Patent Application No. 2007-255474 filed on Sep. 28, 2007 the entire contents of which are hereby incorporated by reference.

BACKGROUND OF THE INVENTION

1. Field of the Invention

The present invention relates to a load control mechanism for an internal combustion engine, which is disposed in the internal combustion engine and structured to partially return an exhaust gas discharged into an exhaust passage to a combustion chamber.

2. Description of Background Art

An internal combustion engine provided with an exhaust gas recirculation (EGR) device for partially returning the exhaust gas to the combustion chamber is known. The internal combustion engine of the aforementioned type has an advantage wherein the a low NOx content of the exhaust gas occurs as compared with the internal combustion engine with no EGR device.

An internal combustion engine normally requires a high fuel consumption rate (hereinafter also referred to as "fuel efficiency"). JP-A No. 2006-233963 discloses the art of introducing the exhaust gas (combusted gas) during the open state of the exhaust valve.

In the internal combustion engine, the amount of intake air to the combustion chamber is adjusted in accordance with the opening degree of the throttle valve. For example, the intake air amount is reduced by decreasing the opening degree of the throttle valve.

In the aforementioned case, as the opening degree of the throttle valve is reduced, the area of the passage which allows the air flow is also reduced. The intake resistance is then raised to generate the so-called pumping loss (see FIG. 5).

The use of the direct-injection stratified-charge engine may be considered for avoiding generation of the pumping loss. In this case, the inside of the combustion chamber is kept substantially at the atmospheric pressure in the intake stroke as shown in FIG. 6, thus avoiding the increase in the pumping loss.

However, in the direct-injection stratified-charge engine, a special mixture gas has to be formed, and the structure is inevitably complicated for the purpose of directly injecting the mixture gas into the combustion chamber. The combustion chamber is further required to be specifically configured to satisfy the aforementioned condition. The atomization of the mixture gas is required to be under strict control. As the exhaust gas contains surplus oxygen by relatively larger amount, the post processing of the NOx has to be considered as well.

The use of the engine with variable intake valve closing time for lean-burn combustion has also been considered as another way for suppressing the pumping loss. However, the capability of the lean-burn combustion for suppressing the pumping loss is limited. The engine with variable intake valve closing time further requires the variable valve mechanism with improved responsiveness and mechanical efficiency.

SUMMARY AND OBJECTS OF THE INVENTION

It is an object of the present invention to provide a load control mechanism for an internal combustion engine with the simple structure capable of avoiding the generation of a pumping loss for improving the fuel efficiency at a lower cost.

For solving the aforementioned problem, an embodiment of the present invention provides a load control mechanism for an internal combustion engine which includes an intake passage for introducing air into a combustion chamber via an intake port. A throttle valve is disposed in the intake passage for adjusting an intake air amount in accordance with an opening degree, an intake valve for allowing/blocking a communication between the combustion chamber and the intake port, an exhaust passage for guiding an exhaust gas discharged from the combustion chamber via an exhaust port, and an exhaust valve for allowing/blocking a communication between the combustion chamber and the exhaust port. A passage for returning the exhaust gas from the exhaust port to the combustion chamber is disposed in the internal combustion engine. An exhaust gas return amount adjustment means is disposed in the passage for adjusting an amount of the exhaust gas returned to the combustion chamber via the passage to an amount which allows a pressure inside the combustion chamber to become substantially an atmospheric pressure.

According to embodiment of the present invention, the amount of exhaust (combusted) gas to be returned from the exhaust port to the combustion chamber is adjusted in accordance with the amount of air (new air) which has passed through the throttle valve in the intake stroke so as to keep the pressure inside the combustion chamber at substantially the atmospheric pressure. More specifically, when the opening degree of the throttle valve is large to increase the amount of new air, the amount of the exhaust gas to be returned is reduced. Meanwhile, when the opening degree of the throttle valve is small to decrease the amount of new air, the amount of the exhaust gas to be returned is increased such that the mass of the gas inside the combustion chamber is kept at substantially a constant value. As a pressure within the combustion chamber is kept at substantially the constant value, the generation of the pumping loss may be avoided, thus improving the fuel consumption rate of the internal combustion engine.

In the aforementioned case, the mechanism according to embodiment of the present invention, has a simply structured as compared with that of the generally employed EGR device, resulting in a reduced in cost.

As the combusted gas at the high temperature is returned to the combustion chamber, the temperature in the combustion chamber in the compression stroke is increased. This may accelerate the combustion of the mixture gas, and as a result, the ignition delay is suppressed, and the degree of constant volume may be improved. The chance of the thermal loss caused by the low-temperature combustion may be reduced, thus reducing the NOx emission.

As no surplus oxygen exists in the combusted gas, NOx may be easily post-processed compared with the stratified charge engine or the lean-burn combustion.

According to embodiment of the present invention, the exhaust gas return amount adjustment means returns the exhaust gas to the combustion chamber via the passage when a difference between a pressure of the exhaust gas discharged from the exhaust port and a pressure inside the combustion chamber becomes equal to or larger than a predetermined value. That is, when the pressure difference is equal to or larger than the predetermined value, the exhaust gas is not returned to the combustion chamber. Thus, a generation of a pumping loss may be easily avoided.

According to embodiment of the present invention, the exhaust gas return amount adjustment means may be formed of a one-way valve. In this case, the load control mechanism for the internal combustion engine may have a simpler structure.

The one-way valve may be formed to include a spring member. In this case, the spring member may be formed to have a spring constant which is preliminarily set to be operable when the difference between the pressure of the exhaust gas discharged from the exhaust port and the pressure inside the combustion chamber becomes equal to or larger than the predetermined value. As the one-way valve is not opened in the exhaust stroke, the exhaust gas may be easily controlled not to return to the combustion chamber.

The exhaust gas return amount adjustment means may be formed to have a valve for opening and closing the passage, detection means for detecting a pressure within a combustion chamber, and control means for determining whether the valve is opened/closed based on a pressure difference between an atmospheric pressure and the pressure within the combustion chamber. In this case, the amount of the exhaust gas returning to the combustion chamber may be controlled with high accuracy.

The valve may be formed of an electromagnetic member, for example, a linear solenoid.

According to embodiment of the present invention, a passage is provided through which the exhaust gas is returned to the combustion chamber from the exhaust port in the internal combustion engine. The passage is further provided with the exhaust gas return amount adjustment means so as to adjust the amount of the exhaust gas which returns in the intake stroke in accordance with the amount of air which has passed through the throttle valve to be introduced into the combustion chamber. The inside of the combustion chamber is held at substantially the atmospheric pressure. This makes it possible to easily avoid the generation of the pumping loss, and improve the fuel consumption rate of the internal combustion engine.

According to embodiment of the present invention, the load control mechanism for the internal combustion engine has a considerably simpler structure. This makes it possible to largely reduce the cost compared with the use of the stratified-charge engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of a load control mechanism for an internal combustion engine according to the present invention will be described in correlation with the internal combustion engine equipped with the load control mechanism referring to the accompanied drawings.

Figure 1:
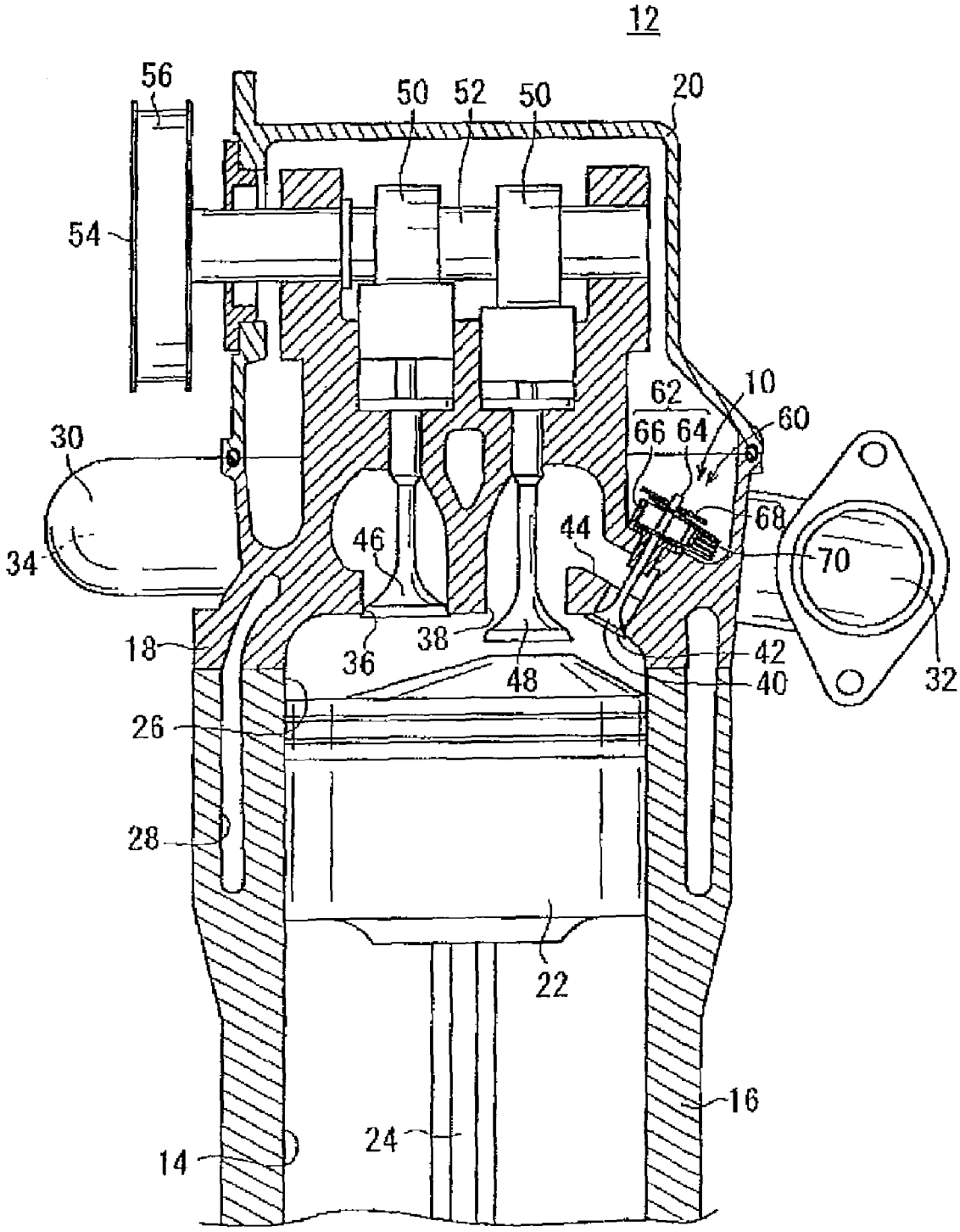
FIG. 1 is a schematic longitudinal sectional view of an essential portion of an internal combustion engine equipped with a load control mechanism according to an embodiment.

FIG. 1 is a longitudinal sectional view showing an essential portion of an internal combustion engine 12 equipped with a load control mechanism 10 for the internal combustion engine (hereinafter also referred to as a load control mechanism) according to an embodiment. The internal combustion engine 12 is mounted on a vehicle such as a motorcycle for combusting the air-fuel mixture to drive the vehicle.

The internal combustion engine 12 will be described. The internal combustion engine 12 includes a block body 16 provided with a cylinder 14, a cylinder head 18 connected to the upper portion of the block body 16, and a head cover 20 which covers and protects the upper portion of the cylinder head 18.

A piston 22 is inserted into the cylinder 14, and is connected to a crankshaft (not shown) via a connecting rod 24. A combustion chamber 26 is defined by the upper end surface of the piston 22 and a space covered with the cylinder head 18. As shown in FIG. 1, a water jacket portion 28 is provided.

An intake manifold 30 and an exhaust manifold 32 are connected to the cylinder head 18. Each of the intake manifold 30 and the exhaust manifold 32 has a hollow body which allows the intake air and the exhaust gas which has been combusted in the combustion chamber 26 to flow. That is, the intake manifold 30 and the exhaust manifold 32 function as the intake passage and the exhaust passage, respectively.

Figure 2:
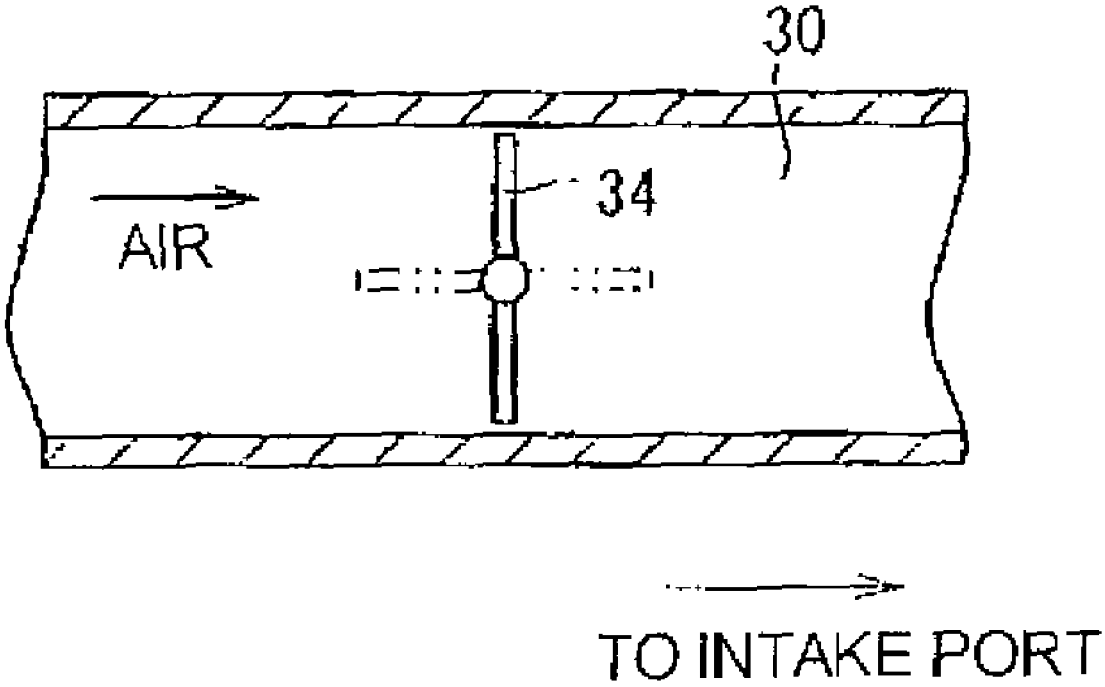
FIG. 2 is a schematic longitudinal sectional view of an essential portion, schematically representing a structure of a throttle valve which forms the internal combustion engine shown in FIG. 1.

A throttle valve 34 shown in FIG. 2 is disposed in the intake manifold 30. The throttle valve 34 rotates in accordance with the operation of the accelerator pedal as operated by the rider. It moves in the range from the position as shown by a solid line (idling position) to a two-dot chain line (full-load position) shown in FIG. 2 in response to accelerator manipulated variable.

An intake port 36 in communication with the intake manifold 30 and an exhaust port 38 in communication with the exhaust manifold 32 are disposed inside the cylinder head 18 (see FIG. 1). A small port 42 is disposed around the exhaust port 38, which allows a later described valve body 40 which forms the load control mechanism 10 to be seated thereon or to move away therefrom. The small port 42 is communicated with the exhaust port 38 via a communication passage 44.

That is, the internal combustion engine 12 contains a bypass passage, that is, the communication passage 44 formed between the exhaust port 38 and the combustion chamber 26.

The intake port 36 is provided with an intake valve 46, and the exhaust port 38 is provided with an exhaust valve 48. The intake valve 46 and the exhaust valve 48 are displaced under the operation of a camshaft 52 via a rocker arm 50 for an opening and a closing operation.

Figure 3:
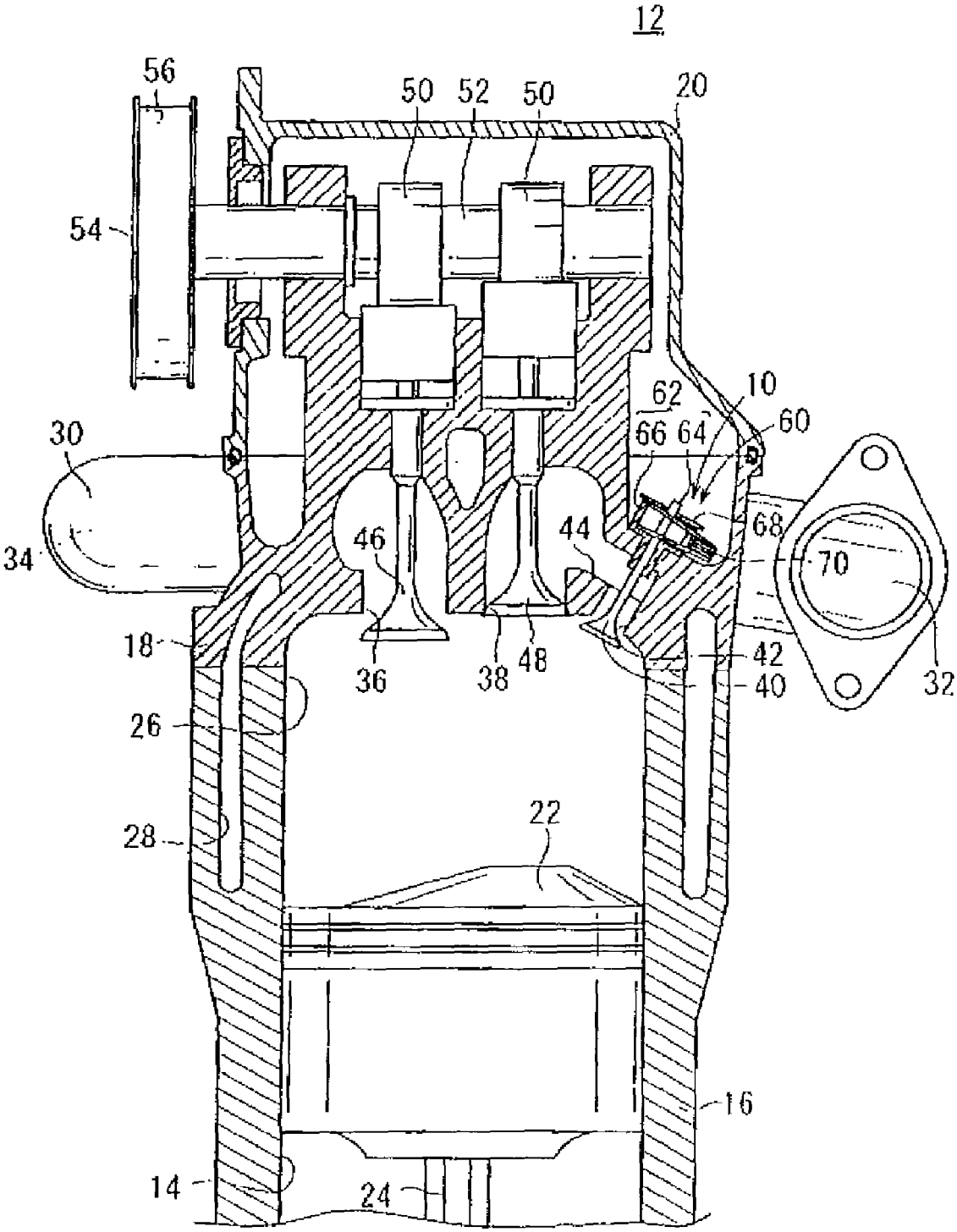
FIG. 3 is a schematic longitudinal sectional view of an essential portion with respect to a state where an intake valve and a one-way valve are opened in the internal combustion engine shown in FIG. 1.

One end of the camshaft 52 is exposed from the head cover 20, and connected to a pulley 54. Accompanied with the rotation of the camshaft 52 driven by a belt 56 wound around the pulley 54, the intake valve 46 and the exhaust valve 48 move up and down as shown in FIGS. 1 and 3. Referring to FIGS. 1 and 3, the aforementioned vertical movements block the communication between the intake port 36 and the combustion chamber 26, and allow communication between the combustion chamber 26 and the exhaust port 38 (see FIG. 1), or allow communication between the intake port 36 and the combustion chamber 26, and block the communication between the combustion chamber 26 and the exhaust port 38 (see FIG. 3).

In the embodiment, the load control mechanism 10 includes a one-way valve 60 which serves as the exhaust gas return amount adjustment means. In this case, the one-way valve 60 is disposed adjacent to the exhaust valve 48.

As described above, since a wide end portion (umbrella-like portion) of the valve body 40 is seated on or moves away from the small port 42, the small part 42 is opened and closed.

One end of the stem of the valve body 40 which forms the one-way valve 60 is exposed outside the cylinder head 18, and is engaged with a stopper member 62. The stopper member 62 includes a cylindrical portion 64 interposed between the valve body 40 and the cylinder head 18, and a weir portion 66 with a substantially L-shaped cross section.

A disk member 68 is further fit with the valve body 40. A spring member 70 is interposed between the disk member 68 and the bottom of the weir portion 66. In this case, the spring constant of the spring member 70 is set such that the valve body 40 does not displace toward the combustion chamber 26 under the pressure of the exhaust gas in the exhaust port 38.

The load control mechanism 10 according to the embodiment has the basic structure as described above. The effect and advantage of the load control mechanism will be described hereinafter.

In the exhaust stroke, the exhaust valve 48 displaces toward the combustion chamber 26 such that the exhaust port 38 is communicated with the combustion chamber 26 as shown in FIG. 1. Then the exhaust gas flows into the exhaust manifold 32 via the exhaust port 38. The exhaust gas then partially flows into the communication passage 44.

The small port 42 at this time is kept blocked without being communicated with the combustion chamber 26. This is because, as described above, the spring constant of the spring member 70 which forms the one-way valve 60 is so set that the valve body 40 does not displace toward the combustion chamber 26 under the pressure of the exhaust gas discharged to the exhaust port 38.

Upon transition from the aforementioned state to the intake stroke, the piston 22 moves downward in the cylinder 14 as shown in FIG. 3, and accordingly, the pressure inside the cylinder 14 becomes negative. Meanwhile, accompanied with the rotation of the camshaft 52 under the action of the belt 56 and the pulley 54, the exhaust valve 48 moves up and the intake valve 46 displaces toward the combustion chamber 26. As a result, the exhaust port 38 is blocked, and the intake port 36, that is, the intake manifold 30 and the combustion chamber 26 are communicated such that newly introduced air (new air) which has passed through the throttle valve 34 (see FIG. 2) inside the intake manifold 30 is introduced from the intake manifold 30 to the combustion chamber 26.

The amount of the air newly introduced from the intake manifold 30 to the combustion chamber 26 varies depending on the opening degree of the throttle valve 34. The amount is minimized in the state (idling position) as the solid line in FIG. 2 shows, and maximized in the state (full load position) as the two-dot chain line shows. Accordingly, the pressure within the combustion chamber 26 also varies depending on the opening degree of the throttle valve 34. For example, when the opening degree of the throttle valve 34 is maximized, the negative pressure within the combustion chamber 26 is relieved to become substantially the atmospheric pressure. At this time, the one-way valve 60 is not opened, and the small port 42 is communicated with the combustion chamber 26.

Meanwhile, when the opening degree of the throttle valve 34 is not maximized, the pressure within the combustion chamber 26 is kept negative. So as shown in FIG. 3, the valve body 40 of the one-way valve 60 is forced to move toward the combustion chamber 26. As a result, the small port 42, that is, the exhaust port 38 and the combustion chamber 26 are in communication via the communication passage 44. The exhaust gas (combusted gas) flowing into the communication passage 44 may be introduced into the combustion chamber 26.

As the one-way valve 60 is opened, the spring member 70 is contracted. When the disk member 68 abuts on the leading end of the weir portion 66 of the stopper member 62, the spring member 70 is prevented from being further contracted. As a result, the displacement of the one-way valve 60 toward the combustion chamber 26 is stopped, that is, the opening degree of the one-way valve 60 is maximized.

The opening degree of the one-way valve 60 varies depending on the pressure within the combustion chamber 26, that is, the level of the negative pressure. More specifically, when the amount of the newly introduced air is large and the negative pressure is at the low level, the force for pulling the valve body 40 is relatively low. The opening degree, thus, becomes small. Meanwhile, when the amount of the newly introduced air is small, and the negative pressure is at the high levels the force for pulling the valve body 40 becomes high. The opening degree, thus, becomes large. When the negative pressure within the combustion chamber 26 is relieved to the predetermined pressure, for example, substantially the atmospheric pressure, the valve body 40 retracts toward the small port 42 under the elastic operation of the spring member 70, and the one-way valve 60 is closed. The spring member 70 extends to assume the original state.

Figure 4:
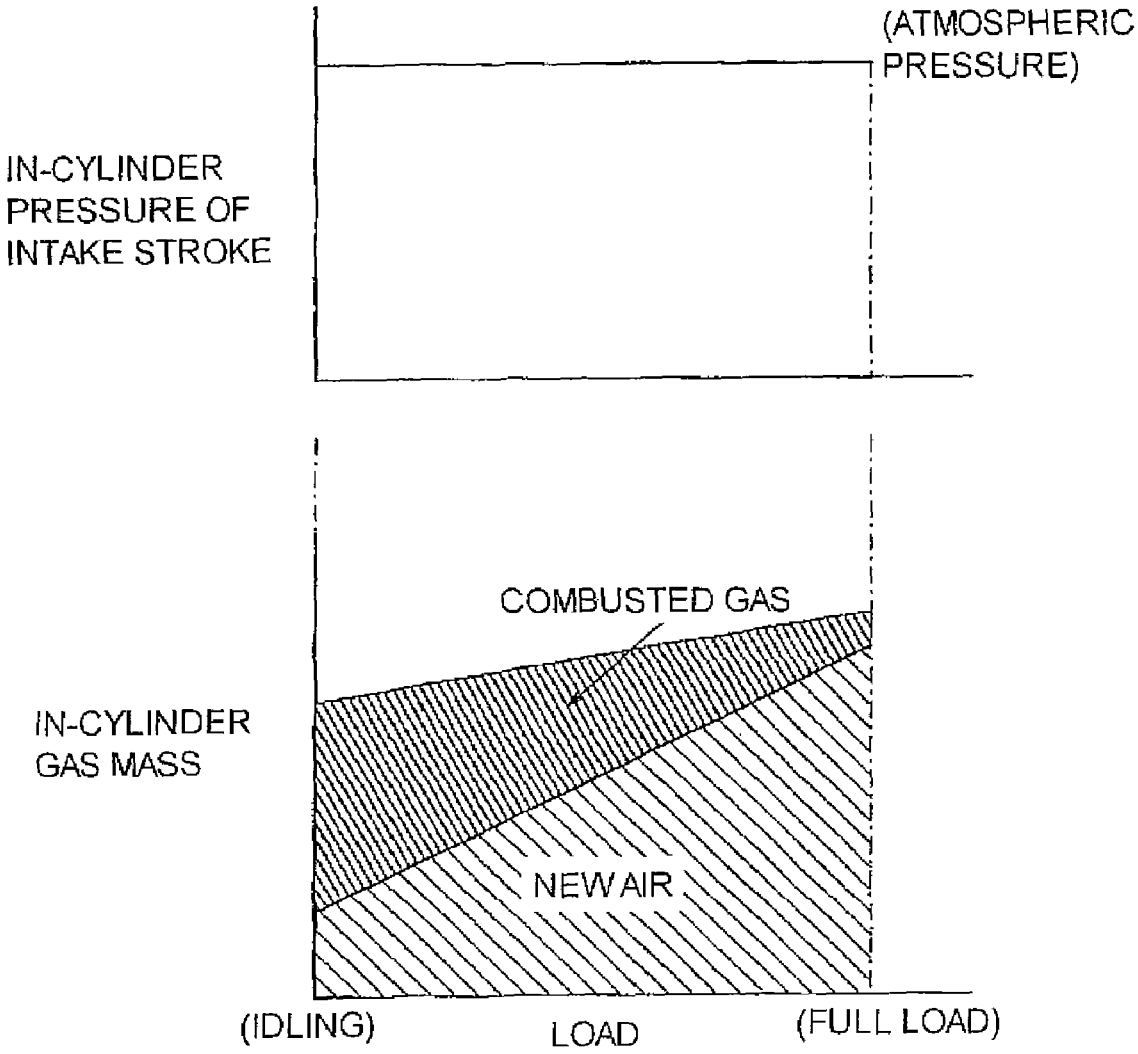
FIG. 4 is a graph showing a relationship with respect to the intake gas amount between the newly introduced air and the exhaust (combusted) gas, and the relationship with respect to the pressure within the combustion chamber in the internal combustion engine shown in FIG. 1.
Figure 5:
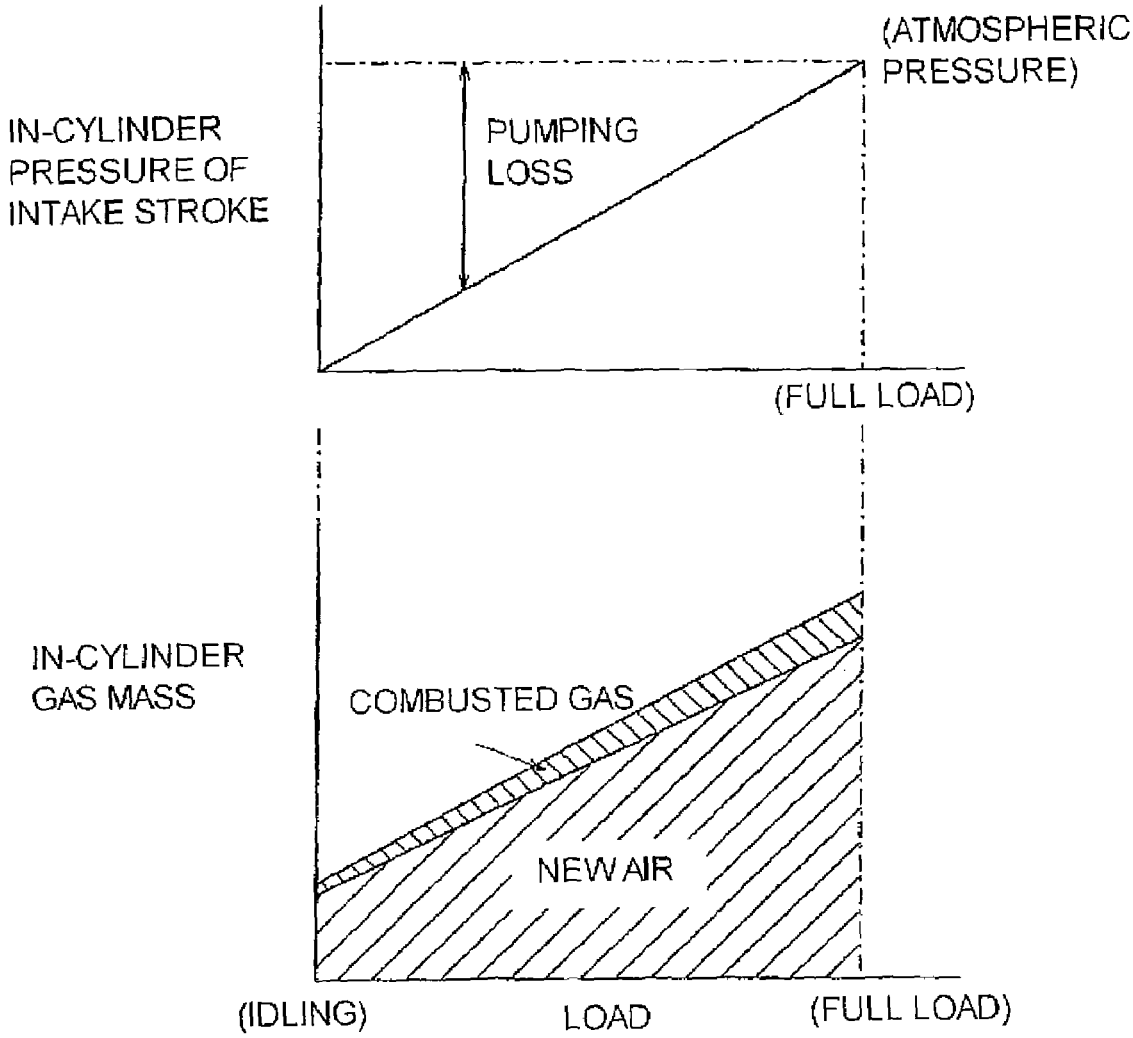
FIG. 5 is a graph showing a relationship with respect to the intake air amount between the newly introduced air and the combusted gas, and the relationship with respect to the pressure within the combustion chamber in a generally employed internal combustion engine.
Figure 6:
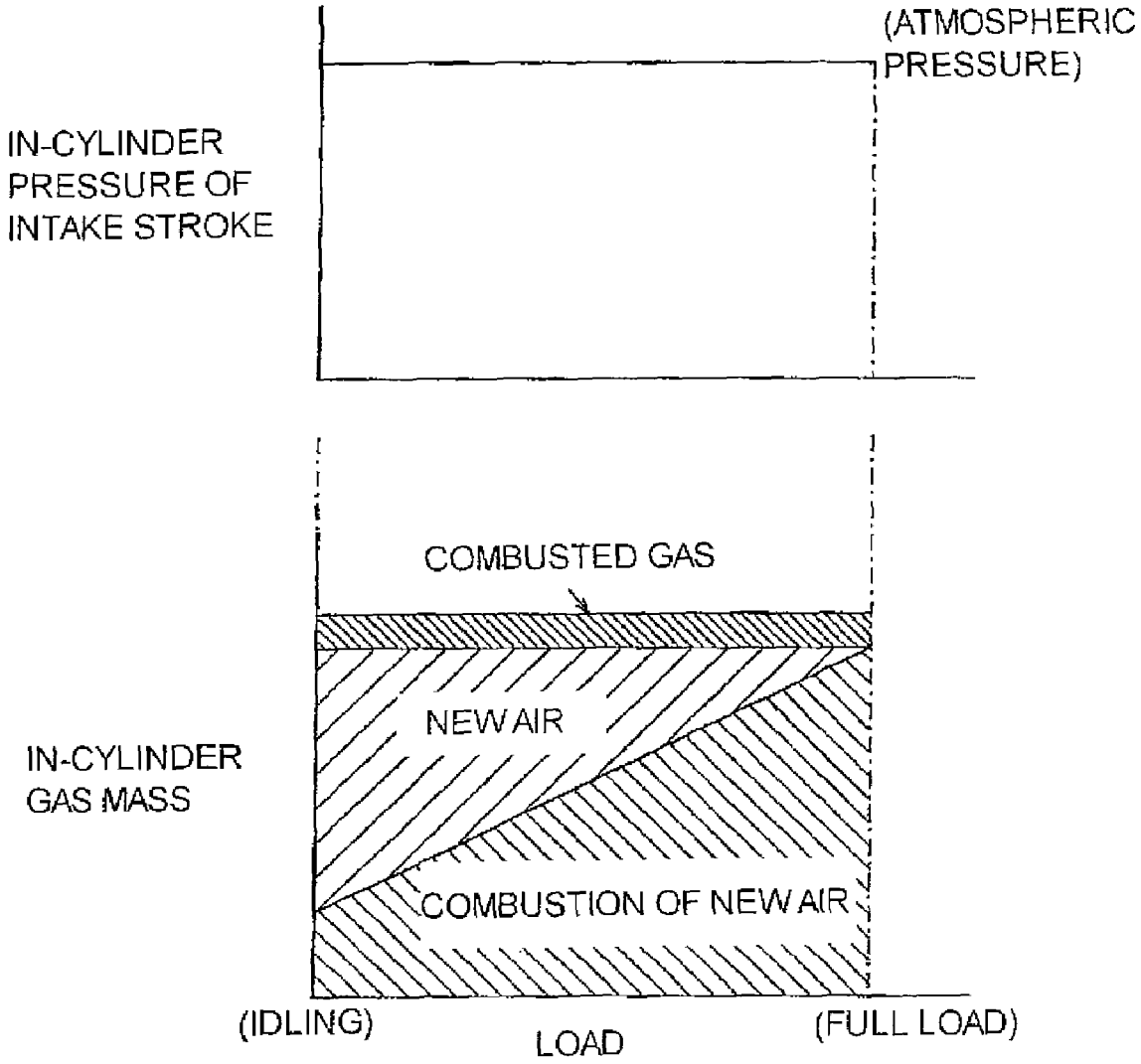
FIG. 6 is a graph showing a relationship with respect to the intake air amount between the newly introduced air and the combusted gas, and the relationship with respect to the pressure within the combustion chamber in a direct-injection stratified-charge engine.

The opening degree of the one-way valve 60 is autonomously adjusted depending on the amount of air newly introduced into the combustion chamber 26. As a result, as shown in FIG. 4, the inside of the combustion chamber 26 is kept substantially at the atmospheric pressure. As the inside of the combustion chamber 26 is kept at substantially the atmospheric pressure, generation of the pumping loss may be avoided. This makes it possible to improve the fuel consumption rate in the internal combustion engine 12.

In the embodiment, no specific means for adjusting the opening of the one-way valve 60 (exhaust gas return amount adjustment means) is required. The inside of the combustion chamber 26 may be kept at substantially the atmospheric pressure with the simple structure. In other words, the fuel consumption rate may be improved while avoiding a generation of the pumping loss. In addition, the structure becomes considerably simple as compared with the generally employed EGR device. As the structure becomes simple, the cost may be further reduced.

As the high temperature combusted gas is returned into the combustion chamber 26, the temperature of the combustion chamber 26 in the compression stroke is increased. As a result, the combustion of the mixture gas is promoted, thus suppressing the so-called ignition delay, and improving the degree of constant volume.

As the combusted gas is returned into the combustion chamber 26, the thermal loss caused by the low temperature combustion may be suppressed, and the NOx emission may also be reduced. As no surplus oxygen exists in the combusted gas, the post processing of NOx may be easily performed compared with the case using the stratified charge engine and the lean-burn combustion.

When the piston 22 moves up again, the new air (and exhaust gas) is compressed, and as a result, the pressure within the combustion chamber 26 is increased. As the camshaft 52 rotates under the action of the belt 56 and the pulley 54, the intake valve 46 moves up and the exhaust valve 48 displaces toward the combustion chamber 26 so as to return to the state shown in FIG. 1. As the pressure in the combustion chamber 26 is not brought to be negative during the aforementioned period, the one-way valve 60 does not displace toward the combustion chamber 26, and accordingly, the small port 42 is not opened. More specifically, the exhaust gas does not return to the combustion chamber 26 via the one-way valve 60.

As described above, the bypass passage is formed between the exhaust port 38 and the combustion chamber 26, and the load control mechanism 10 such as the one-way valve 60 is disposed in the bypass passage so as to avoid the generation of the pumping loss. This makes it possible to further improve the fuel efficiency.

In the aforementioned embodiment, an opening degree control means for controlling the opening degree of the one-way valve 60 is not provided. However, the opening degree control means may be disposed to form the load control mechanism together with the one-way valve 60 (exhaust gas return amount adjustment means). The variable valve opening pressure mechanism for varying the pressure at which the valve body 40 starts displacing may be disposed to form the load control mechanism.

The spring constant of the spring member 70 may be set such that the resonance frequency deviates from the range of the eigen frequency of the internal combustion engine 12. For example, the resonance frequency may be set so as not to vibrate at the primary vibration frequency and the secondary vibration frequency of the internal combustion chamber 12. At least two spring members each having the different spring constant are connected in parallel so as to avoid the generation of the resonance.

The exhaust gas return amount adjustment means may be formed as a valve body which operates based on the pressure difference between the exhaust gas discharged from the exhaust port 38 and the pressure within the combustion chamber 26, for example, such elastic member as the lead valve.

Alternatively, the exhaust gas return amount adjustment means may be formed of a solenoid valve such as the linear solenoid which electromagnetically opens/closes, combustion chamber pressure detection means for detecting the pressure within the combustion chamber 26, and a control unit for determining whether the solenoid valve is opened/closed based on the pressure difference between the atmospheric pressure and the pressure within the combustion chamber 26. In the aforementioned case, the solenoid valve is structured to be opened to communicate the communication passage 44 with the combustion chamber 26 only when the control unit determines to "return the exhaust gas into the combustion chamber 26."

Alternatively, the variable valve mechanism may be employed instead of the one-way valve 60 as the exhaust gas return amount adjustment means.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A load control mechanism for an internal combustion engine comprising:

an intake passage for introducing air into a combustion chamber via an intake port;

a throttle valve disposed in the intake passage for adjusting an intake air amount in accordance with an opening degree;

an intake valve for allowing/blocking communication between the combustion chamber and the intake port;

an exhaust passage for guiding an exhaust gas discharged from the combustion chamber via an exhaust port; and an exhaust valve for allowing/blocking communication between the combustion chamber and the exhaust port;

wherein a passage for returning the exhaust gas from the exhaust port to the combustion chamber is disposed in the internal combustion engine; and exhaust gas return amount adjustment means is disposed in the passage for adjusting an amount of the exhaust gas returned to the combustion chamber via the passage to an amount which allows a pressure inside the combustion chamber to become substantially an atmospheric pressure, wherein the exhaust gas return amount adjustment means is formed of a one-way valve, and the exhaust gas return amount adjustment means is configured to open only when the pressure within the combustion chamber becomes a negative pressure.

2. The load control mechanism for an internal combustion engine according to claim 1, wherein the exhaust gas return amount adjustment means returns the exhaust gas to the combustion chamber via the passage when a difference between a pressure of the exhaust gas discharged from the exhaust port and a pressure inside the combustion chamber becomes equal to or larger than a predetermined value.

3. The load control mechanism for an internal combustion engine according to claim 2, wherein the exhaust gas return amount adjustment means is formed of a one-way valve.

4. The load control mechanism for an internal combustion engine according to claim 3, wherein the one-way valve includes a spring member and the spring member has a spring constant which is preliminarily set to be operable when the difference between the pressure of the exhaust gas discharged from the exhaust port and the pressure inside the combustion chamber becomes equal to or larger than the predetermined value.

5. The load control mechanism for an internal combustion engine according to claim 1, wherein the exhaust gas return amount adjustment means includes:

a valve for opening and closing the passage;

detection means for detecting a pressure within a combustion chamber; and control means for determining whether the valve is opened/closed based on a pressure difference between an atmospheric pressure and the pressure within the combustion chamber.

6. The load control mechanism for an internal combustion engine according to claim 5, wherein the valve is formed of a linear solenoid.

7. The load control mechanism for an internal combustion engine according to claim 1, wherein the passage for returning the exhaust gas to the combustion chamber is disposed directly adjacent to the exhaust valve and the exhaust gas return amount adjustment means includes a valve body disposed within the passage for returning the exhaust gas to the combustion chamber.

8. A load control mechanism for an internal combustion engine comprising:

an intake passage for introducing air into a combustion chamber via an intake port;

an intake valve for allowing/blocking communication between the combustion chamber and the intake port;

an exhaust passage for guiding an exhaust gas discharged from the combustion chamber via an exhaust port;

an exhaust valve for allowing/blocking communication between the combustion chamber and the exhaust port;

a passage for returning the exhaust gas from the exhaust port to the combustion chamber, said passage being disposed in the internal combustion engine; and exhaust gas return amount adjustment means being disposed in the passage for adjusting an amount of the exhaust gas returned to the combustion chamber via the passage to an amount which allows a pressure inside the combustion chamber to become substantially an atmospheric pressure.

9. The load control mechanism for an internal combustion engine according to claim 8, wherein the exhaust gas return amount adjustment means returns the exhaust gas to the combustion chamber via the passage when a difference between a pressure of the exhaust gas discharged from the exhaust port and a pressure inside the combustion chamber becomes equal to or larger than a predetermined value.

10. The load control mechanism for an internal combustion engine according to claim 9, wherein the exhaust gas return amount adjustment means is formed of a one-way valve.

11. The load control mechanism for an internal combustion engine according to claim 10, wherein the one-way valve includes a spring member and the spring member has a spring constant which is preliminarily set to be operable when the difference between the pressure of the exhaust gas discharged from the exhaust port and the pressure inside the combustion chamber becomes equal to or larger than the predetermined value.

12. The load control mechanism for an internal combustion engine according to claim 8, wherein the exhaust gas return amount adjustment means includes:

a valve for opening and closing the passage;

detection means for detecting a pressure within a combustion chamber; and control means for determining whether the valve is opened/closed based on a pressure difference between an atmospheric pressure and the pressure within the combustion chamber.

13. The load control mechanism for an internal combustion engine according to claim 12, wherein the valve is formed of a linear solenoid.

14. The load control mechanism for an internal combustion engine according to claim 8, wherein the passage for returning the exhaust gas to the combustion chamber is disposed directly adjacent to the exhaust valve and the exhaust gas return amount adjustment means includes a valve body disposed within the passage for returning the exhaust gas to the combustion chamber.

15. A load control mechanism for an internal combustion engine comprising:

an intake passage for introducing air into a combustion chamber via an intake port;

an exhaust passage for guiding exhaust gas discharged from the combustion chamber via an exhaust port;

an intake valve operatively positioned relative to the intake port for allowing/blocking communication between the combustion chamber and the intake port;

an exhaust valve operatively positioned relative to the exhaust port for allowing/blocking communication between the combustion chamber and the exhaust port;

a passage for returning the exhaust gas from the exhaust port, said passage being selectively in communication between the exhaust passage and the combustion chamber; and exhaust gas return amount adjustment means disposed in the passage for adjusting an amount of the exhaust gas returned to the combustion chamber via the passage to an amount which allows a pressure inside the combustion chamber to become substantially an atmospheric pressure.

16. The load control mechanism for an internal combustion engine according to claim 15, wherein the exhaust gas return amount adjustment means returns the exhaust gas to the combustion chamber via the passage when a difference between a pressure of the exhaust gas discharged from the exhaust port and a pressure inside the combustion chamber becomes equal to or larger than a predetermined value.

17. The load control mechanism for an internal combustion engine according to claim 16, wherein the exhaust gas return amount adjustment means is formed of a one-way valve.

18. The load control mechanism for an internal combustion engine according to claim 17, wherein the one-way valve includes a spring member and the spring member has a spring constant which is preliminarily set to be operable when the difference between the pressure of the exhaust gas discharged from the exhaust port and the pressure inside the combustion chamber becomes equal to or larger than the predetermined value.

19. The load control mechanism for an internal combustion engine according to claim 15, wherein the exhaust gas return amount adjustment means includes:

a valve for opening and closing the passage;

detection means for detecting a pressure within a combustion chamber; and control means for determining whether the valve is opened/closed based on a pressure difference between an atmospheric pressure and the pressure within the combustion chamber.

20. The load control mechanism for an internal combustion engine according to claim 19, wherein the valve is formed of a linear solenoid.

* * * * *